US005630300A

United States Patent [19]

Chen

[11] Patent Number: 5,630,300

[45] Date of Patent: May 20, 1997

[54] LOW RAISED ACCESS FLOOR STRUCTURE FOR OFFICE AUTOMATION

[76] Inventor: Yao-Chung Chen, 7F, No. 214, Sec. 3, Ta-Tung Rd., Hsi-Chieh Chen, Taipei Hsien, Taiwan

[21] Appl. No.: 593,356

[22] Filed: Jan. 29, 1996

[51] Int. Cl.[6] ..... E04C 2/52

[52] U.S. Cl. ..... 52/220.5; 52/220.1; 174/48

[58] Field of Search ..... 52/220.5, 220.3, 52/220.1, 220.2, 220.8, 263; 174/48, 49

[56] References Cited

U.S. PATENT DOCUMENTS

| | | | |
|---|---|---|---|
| 3,303,264 | 2/1967 | Saul et al. | 52/220.3 X |
| 3,593,472 | 7/1971 | Bargar | 52/220.5 X |
| 3,903,667 | 9/1975 | Zetlin | 52/220.3 X |
| 4,040,755 | 8/1977 | Jorgensen et al. | 52/220.5 X |
| 4,858,401 | 8/1989 | Thorp et al. | 52/220.3 X |
| 4,968,855 | 11/1990 | Le Paillier | 52/220.3 X |
| 5,163,258 | 11/1992 | Habraken et al. | 52/220.3 |
| 5,263,289 | 11/1993 | Boyd | 52/220.5 X |
| 5,434,355 | 7/1995 | Sho | 52/220.3 X |

*Primary Examiner*—Creighton Smith

*Attorney, Agent, or Firm*—Beveridge, DeGrandi, Weilacher & Young, L.L.P.

[57] ABSTRACT

A low raised access floor structure having widened spacing between the floor posts thereof and allowing more communication cables or bus bar wires to pass underneath. This unique structure solves the problems caused by unevenness of the construction ground and further provides the benefits of shortening the time required for installation, simplifying the construction work, and production is at a low cost. In addition, the arrangement of outlets can be changed in a quick and easy manner without adverse influence in the integrity of the outer appearance.

12 Claims, 5 Drawing Sheets

51
5
2A
51
52
2A
31
32
12
C
B
B
C
A
C
B
B
C
1
10
11
14
13
4
41
42
3
22
21
2

LOW RAISED ACCESS FLOOR STRUCTURE FOR OFFICE AUTOMATION

BACKGROUND OF THE INVENTION

1. Field of the Invention

The invention relates to a low raised access floor structure that is adaptable to all occasions using a low raised access floor with an average office, a convention room, a computer room, and so on for promoting working efficiency. Moreover, the low raised access floor structure of the present invention is also suitable for the construction of an audio and/or video room, a living room, and a study room in an ordinary family house to keep it tidy and smart. Thus the floor structure according to the invention is not restricted to some special occasions but is also applicable to other featured buildings.

2. Description of a Prior Art

The development of the low raised access floor structure has been conducted for a long time. Most improvements are local, fragmented, and scattered. There is seldom suggested a revolutionary proposal about the whole structure. Thus, many problems still remain.

In a low raised access floor structure shown in FIG. 1, some drawbacks that are often seen in conventional structures have been eliminated such as the arrangement of outlets and looseness. However, the following drawbacks stay inherently.

Narrow spacing between the floor posts limits the number of communication cables or bus bar wires passing under the floor. When a large quantity of cables are routed along the same course, they must be rearranged to different paths, which may lead to pulling the floor apart, relocating outlets, rebuilding the floor, installing safety guard devices and so on. It is not only troublesome but also costly.

The construction of a conventional low raised access floor structure needs detailed site measurement and drawing to figure out joining locations, which influences the arrangement of the floor. It is time-consuming due to the high accuracy needed in such work. Therefore, such construction is not cost effective.

Conventional floors do not correspond to carpets or floor decorative materials of popular sizes so that the arrangement of the underlying floors can not be figured out unless lifting the covers. This makes wiring maintenance inconvenient. In addition, if the joins of the carpets or floor decorative materials are right above those of the floors, it is hard to make the carpets or floor decorative materials adhered to the floors at these joins. Besides, in the prior art, the outlets included in the floor structure used to have a top surface higher than the floor surfaces due to various causes in structural design, which makes the pavement of the floor decorative material difficult and the floor surface rugged, in turn affecting the arrangement of furniture.

Therefore, it is desirable to have an improved low raised access fleer structure in which the above-mentioned drawbacks have been removed.

SUMMARY OF THE INVENTION

The primary object of the invention is to provide an improved low raised access floor structure that allows more cables or bus bar wires passing underneath and can overcome the problem caused by a slightly uneven construction ground, provide convenience in installation, simplify the construction work, and can be made in a low cost.

Additionally, the arrangement of the outlets according to the invention can be in harmony with the floor structure in a visual effect, presenting the integrity of the outer appearance.

Another object of the invention is to provide a low raised access floor structure that does not need to spend time in careful alignment and positioning among parts during construction and thus attains the effects of saving time, labor, and costs.

To accomplish the objects of the invention, a low raised access floor structure is provided which comprises a low raised floor, joining elements, first covers, elongated cable channels, second covers and outlets of type A, B, and C. The distances between floor posts of the invention are larger than those of a conventional floor structure, allowing more communication cables or bus bar wires passing underneath. The floor is divided into a plurality of units in accordance with their locations taken. These units are joined by a film-like thin wall whereby the floor structure can overcome the slight unevenness of the construction ground and facilitate the separation of units for changing or replacing of outlets, furnishing greater adaptability to various environments.

The various parts of the floor structure according to the invention are dimensioned to enable the floor structure to be used in cooperation with carpets or other floor decoration materials of popular sizes in the market. Therefore, the floor structure can provide convenience in maintenance. The joining element of the invention has a plurality of coupling slots formed along the periphery thereof and a hollow column on each of four corners for housing the floor posts. The elongated cable channel has a raised flange on two opposite sides and a tongue on each of the other two sides thereof which is adapted for fitting into the coupling slot on the joining element. With the aids of joining elements, the floor construction according to the invention needs no longer precise alignment between the parts. By means of a combination of joining elements and elongated cable channels and proper expansion of the combination, the construction of the low raised access floor can be quickly done by overlying the first and second covers on the floor in such a way that the protrusions of the second covers extend into the grooves while the protrusions of the first covers locate between neighboring C-type outlets to attain a firm connection. Therefore, evidently the floor structure according to the invention can obtain a time and labor saving effect and can be made at a low cost.

The structure, principles, features, and advantages of the invention will be best understood by reference to the following detailed description when taken in conjunction with the accompanying drawings.

DESCRIPTION OF PREFERRED EMBODIMENTS

Figure 1:
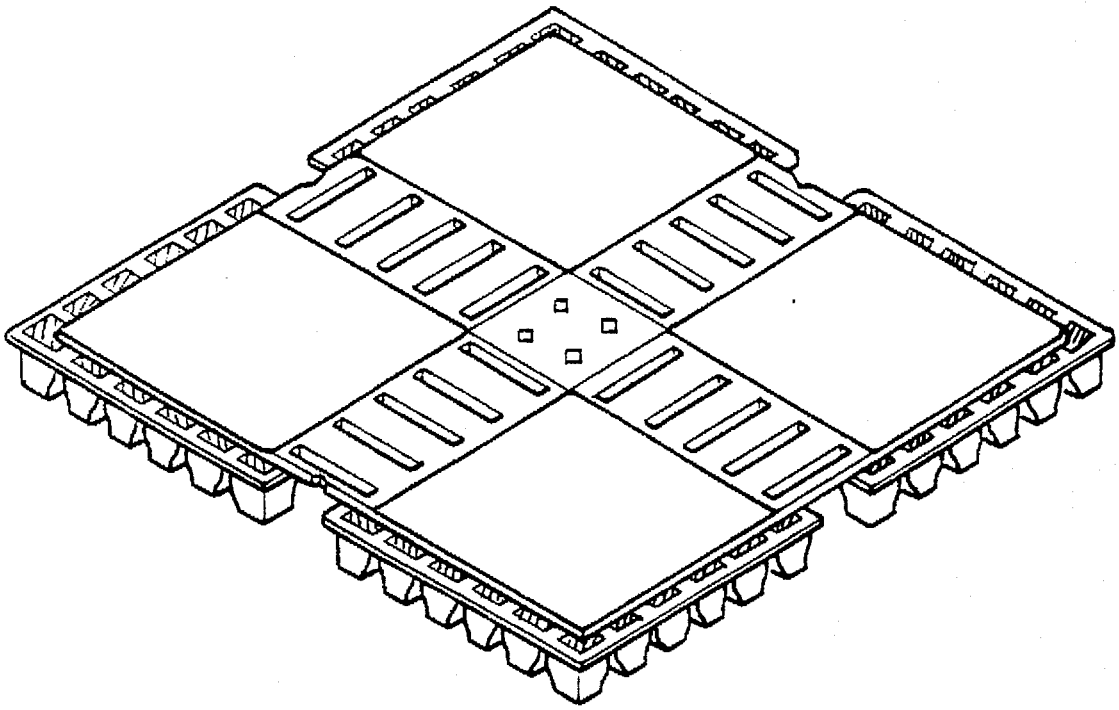
FIG. 1 PRIOR ART
FIG. 1 is a perspective view showing a conventional low raised access floor.
Figures 2, 2A:
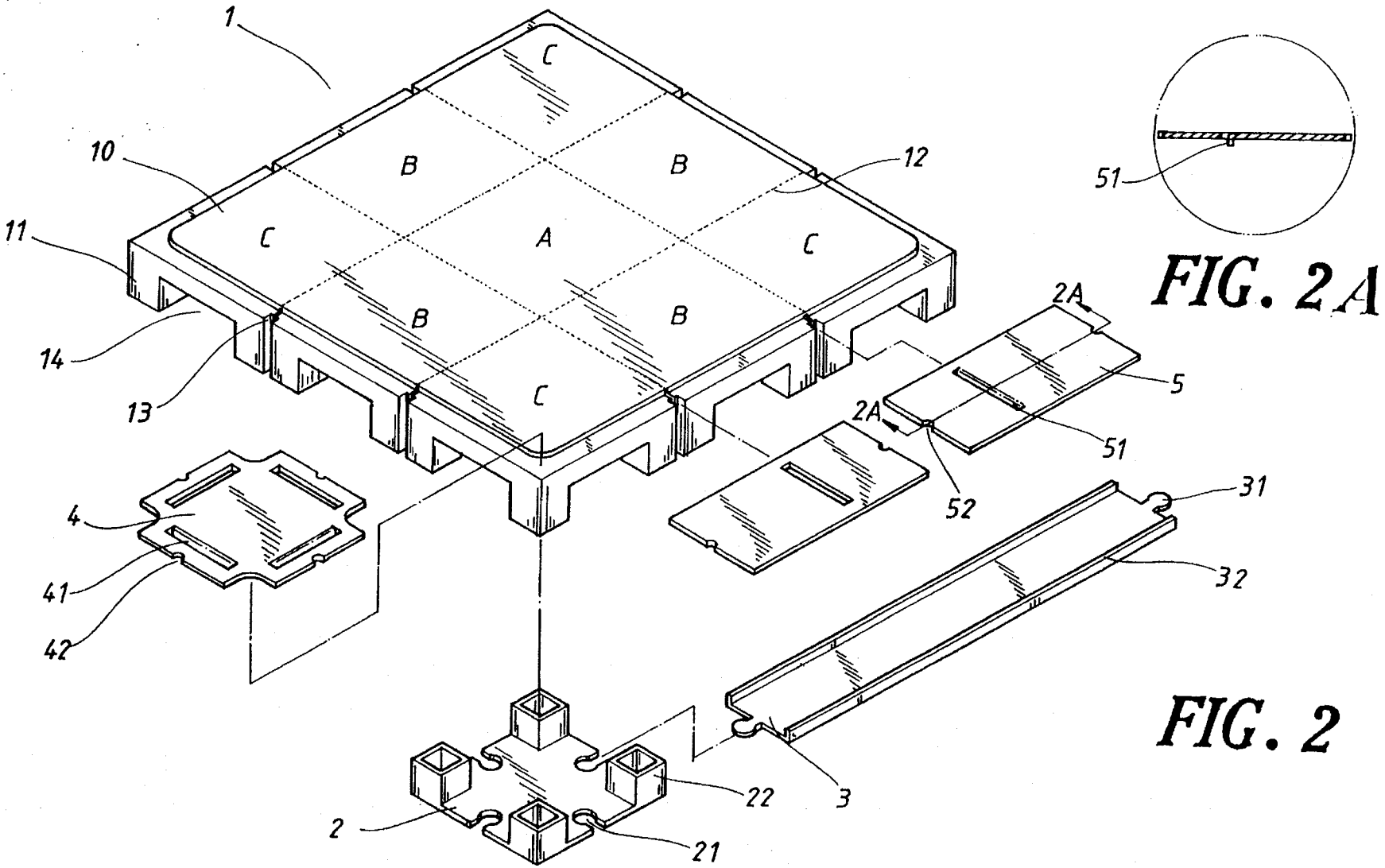
FIG. 2 is an exploded perspective view showing an embodiment of the low raised access floor structure according to the invention.
FIG. 2A is a cross-sectional view taken along the line 2A—2A of FIG. 2.
Figure 3:
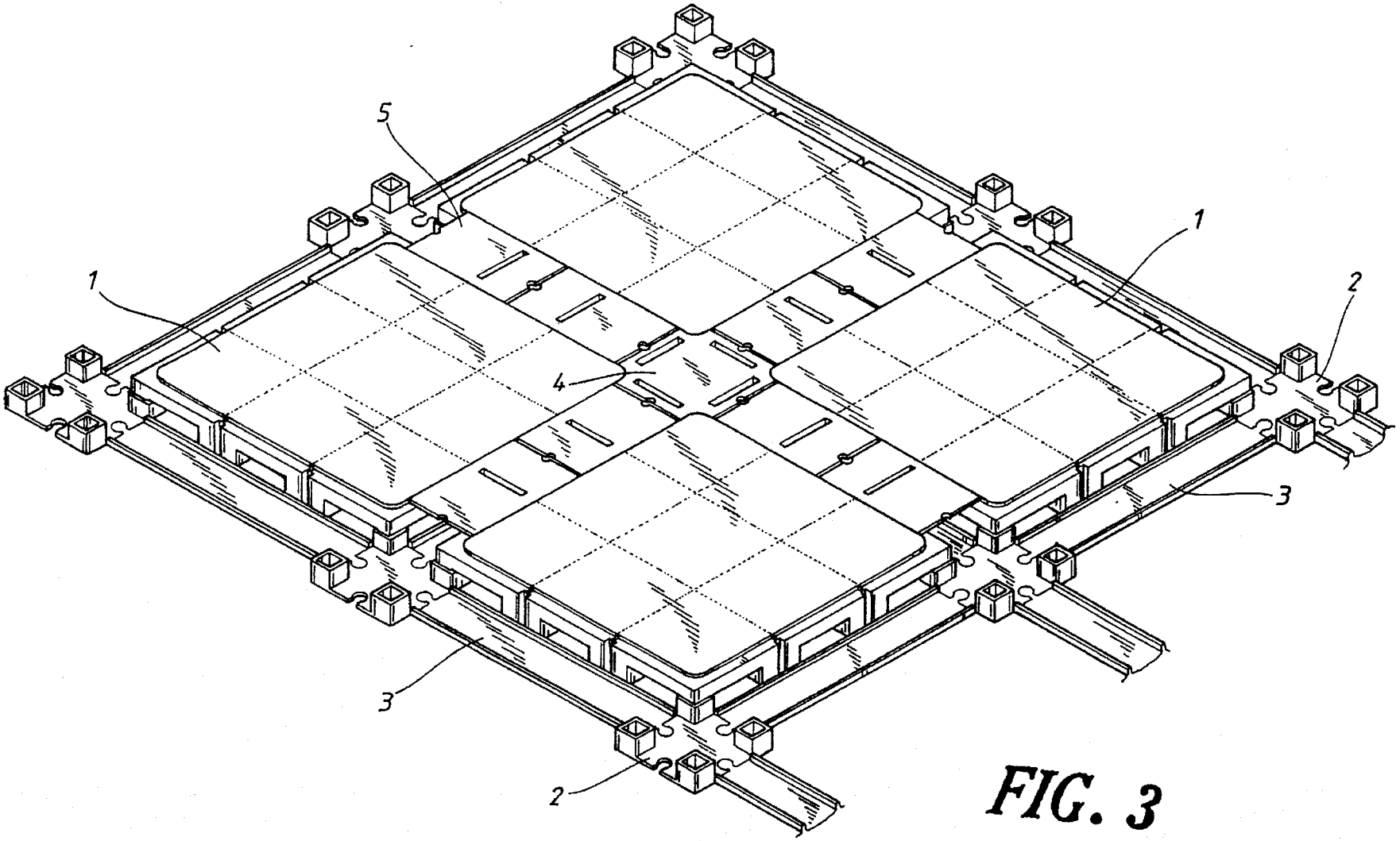
FIG. 3 shows an example for practicing the invention.
Figure 4:
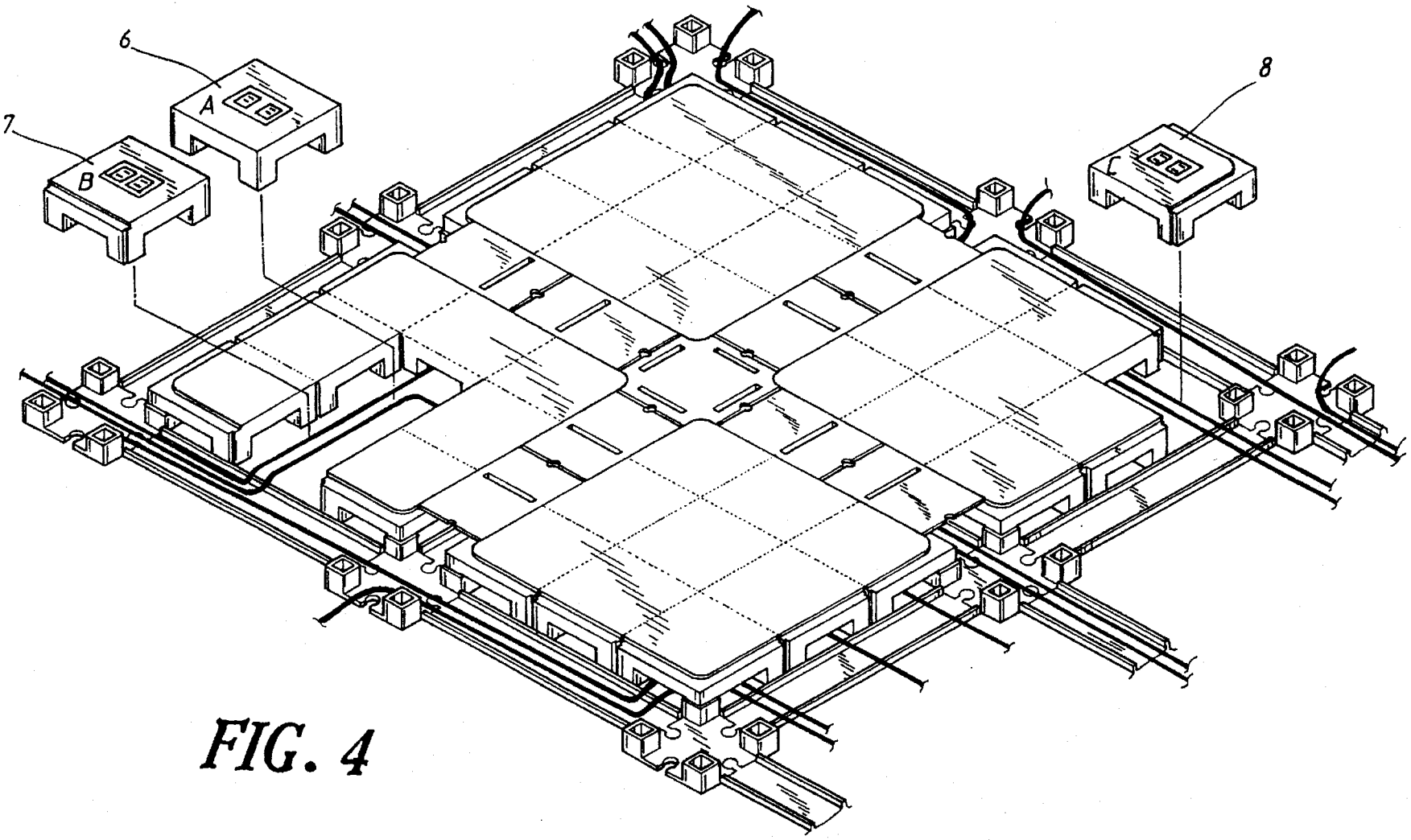
FIG. 4 shows another example for practicing the invention.

Referring to FIGS. 2, 3 and 4, being respectively an exploded view and a perspective view of the invention, it will be seen that the floor structure of the invention is composed of a low-raised access floor (1), joining elements (2), first covers (4), elongated cable channels (3), second covers (5), and a plurality of outlets (6) of type A, outlets (7) of type E, and cutlets (8) of type C, The low raised access floor can be a plastic material such as acrylonitrile butadiene styrene copolymer or polycarbonate material. The spacing between the posts (11) of the floor (1) is larger than those between the posts of a conventional floor so that the floor (1) has larger openings (14) for more communication cables to pass through. In addition, the floor (1) is constituted of nine units arranged in three rows by three columns as shown in FIG. 2. These units are divided into three different types, type A, type B, and type C, in accordance with their positions Each unit has four posts and film-like thin walls (12) are formed between two adjacent units during the molding operation of the floor, which give the floor (1) a flat top surface. Grooves (13) are disposed along the periphery of the floor (1) at the junctions between two adjacent units for the engagement with a protrusion (51) on the second cover (5) as shown in FIG. 2A. The provision of the thin walls (12) is intended to overcome the unevenness of the construction ground and to facilitate the separation and replacement of units by outlets of corresponding types A, B, and C. It should he noted that the A type has no recessed edges, the B type has one recessed side edge, and the C type has two recessed side edges. Accordingly the arrangement of outlets can be adapted t6 individual requirements. The outlet may be either a receptacle of a power cord or a jack for a phone line or a data communication cable. The assembling procedure can be best seen from FIG. 4. If a restoration to the previous state of the floor is needed after a certain unit has been changed, just reverse the procedure without struggling with the whole floor.

Figure 5:
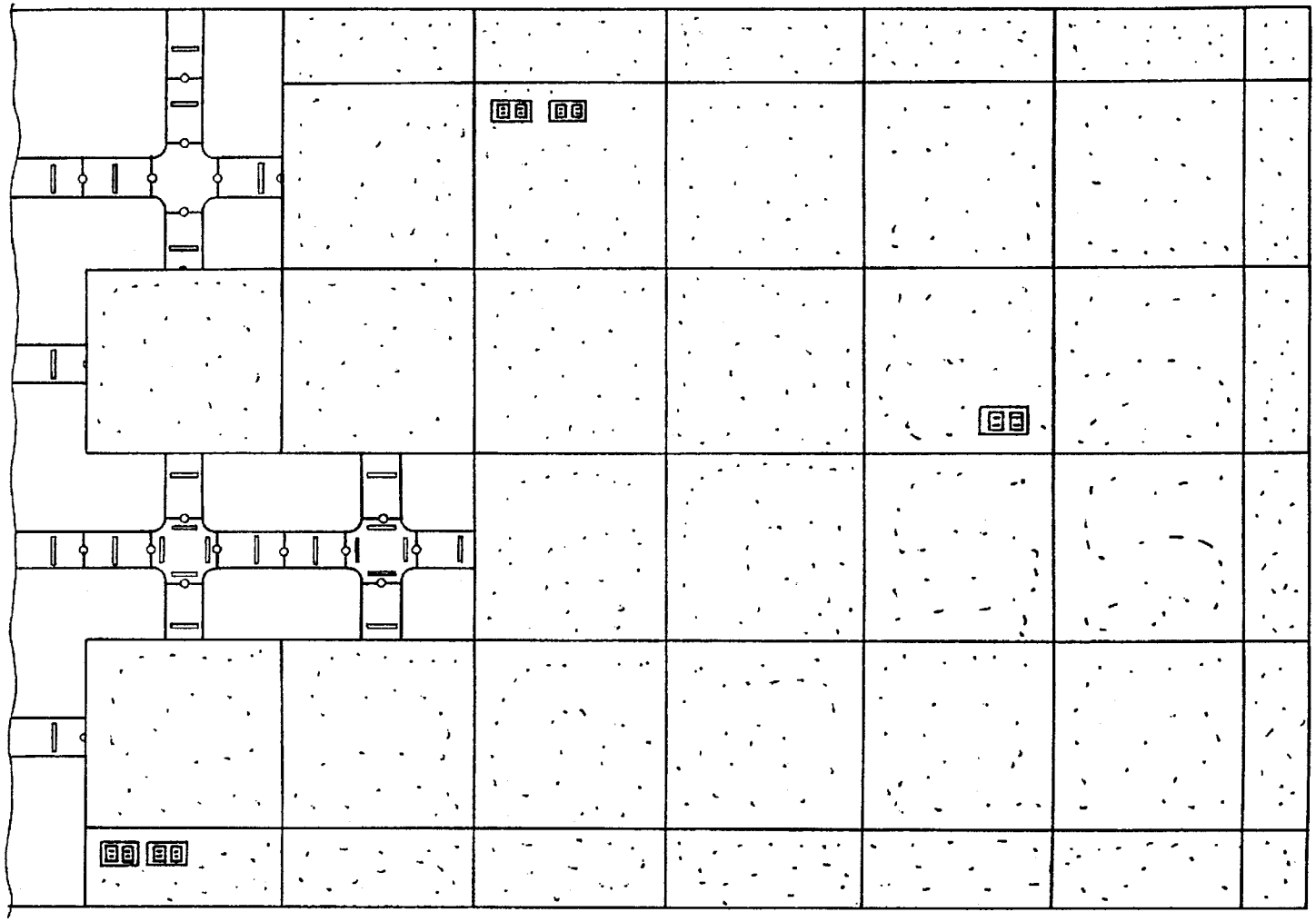
FIG. 5 shows the practice of the invention with a carpet or a floor decorative material.

It should be also noted that various parts of the low raised access floor structure according to the invention are of special sizes. For example, the low raised access floor (1) has a generally square shape forty-three centimeters long for each side, and the elongated cable channel (3) and the second cover (5) both measure seven centimeters by forty-three centimeters. It means that the assembled floor can be used in cooperation with carpets measured fifty centimeter square, which is a popular size for floor decorative materials. Thus the invention can attain convenience in maintenance. FIG. 5 illustrates the practice of the invention with carpets or other floor decorative materials.

The joining element (2) is a square with a hollow column (22) disposed at each corner thereof for accommodating the posts (11) on the four corners of the low raised access floor (1). A coupling slot (21) is made on each side of the joining element (2) for coupling with tongues (31) on the cable channel (3). The cable channel (3) has a raised flange (32) on each of two opposite sides thereof and a tongue on each of the other two sides that must be inserted into the coupling slot (21) when assembled, The provision of the elongated cable channel (3) excludes the need of precisely aligning joining elements (2) during the construction of the floor. Using a combination of joining elements (2) and cable channels (3) and expanding the combinations, the joining elements (2) can be quickly placed and assembled in proper positions and then the low raised access floor (1) may be overlain by the first and the second covers (4), (5), with the protrusions (51) of the second covers (5) extending into the grooves (13) on the floor (1) and the protrusions (41) of the first covers (4) being positioned between C-type outlets (8) of adjacent floors (1). In this way, the floor structure attains a firm union. The first cover (4) is a square with four recessed round corners and has a downward extending elongated protrusion (41) formed at a proper position on the underside surface along each side thereof. In the floor structure the first cover (4) is placed between neighboring C-type outlets (8). The first cover (4) and its protrusions (41) are so configured that when it is mounted in position the top surface of the cover (4) is flush with the floor surface. The second cover (5) has a generally rectangular body with a downwardly extending protrusion (51) formed in the middle thereof which protrusion (51) extends into the groove (13) to assist in the positioning and securing of neighboring floors (1). The second cover (5) is designed to be detachable for installing outlets and so the outlets may be located everywhere on the floor surface. The semicircular holes (42), (52) are respectively provided on each of four sides of the first cover (4) and two opposite ends of the second dover (5) for the convenience of gripping the covers. Obviously, the low raised access fleer structure according to the invention has greater adaptability and can be built in a quick, time and labor saving and cost-effective way.

Consequently, according to the foregoing description, the low raised access floor structure of the present invention has the advantages of simplifying the assembly procedure and enhancing efficiency and construction quality. In addition, it can also allow a great number of cables and bus bar wires passing underneath and has great flexibility in the arrangement of outlets, Thus it has desirable merits in the industry,

What is claimed:

1. A low raised access floor structure comprising:

low raised access floor member;

a square joining element;

a first cover positioned above said square joining element;

an elongated cable channel; and a second cover positioned above said elongated cable channel, wherein, said low raised access floor member comprises a plurality of units connected by a plurality of film-like thin walls to form a square, said square having a flat top surface and a plurality of grooves formed on periphery thereof at a position where said units are connected said square joining element includes a plurality of coupling slots formed on a periphery thereof and a plurality of hollow columns extending therefrom, at least one of said columns being disposed on a corner of said square joining element accommodating posts located on said low raised access floor member, and said elongated cable channel has raised flanges on opposite side edges and a tongue on each end, said tongue engaging said coupling slots of said square joining element.

2. A low raised access floor structure as claimed in claim 1, in which said low raised access floor member comprises nine units arranged in three rows by three columns.

3. A low raised access floor structure as claimed in claim 1, wherein said low raised access floor member, said square joining element, said first cover, aid elongated cable channel, and said second cover constitute a fifty centimeter square so as to be used with square carpets of a same size.

4. A low raised access floor structure as claimed in claim 1, wherein said low raised access floor member, said square joining elements, said first cover, said elongated cable channel, and said second cover constitute an eighteen inch square so as to be used with square carpets of a same size.

5. A low raised access floor structure as claimed in claim 1, wherein one of said coupling slots of said square joining element comprises a short slot communicating with a circular hole having a diameter larger than a width of said short slot, and said tongue formed on said elongated cable channel has a shape corresponding to said coupling slot so that said tongue is fitted into said coupling slot.

6. A low raised access floor structure as claimed in claim 1, further comprising a wire outlet, at least one of said units being said wire outlet and said wire outlet having no recessed edges, one recessed edge, or two recessed edges.

7. An access floor structure, comprising:

a raised floor member having a flat surface, a peripheral shoulder and a plurality of posts;

a cable channel having opposite ends and opposite lateral sides, each of said opposite ends having a coupling tongue and each of said lateral sides having a raised flange;

a joining element having a plurality of hollow columns and a plurality of coupling slots, at least one of said hollow columns engaging one of said posts of said raised floor member and at least one of said coupling slots engaging said coupling tongue of said cable channel;

a first cover supported above said cable channel by a first part of said peripheral shoulder of said raised floor member; and a second cover supported above said joining element by a second part of said peripheral shoulder of said raised floor member.

8. An access floor structure as defined in claim 7, wherein:

said raised floor member comprises a plurality of units, said units being interconnected by a thin surface structure.

9. An access floor structure as defined in claim 8, wherein:

said peripheral shoulder of said raised floor member has a plurality of grooves defined therein at positions proximal to interconnections between said units.

10. An access floor structure as defined in claim 9, wherein:

said first cover has a first plurality of protrusions extending therefrom and engaged with said grooves defined on said peripheral shoulder of said raised floor member.

11. An access floor structure as defined in claim 10, wherein:

said second cover has a second plurality of protrusions positioned adjacent to said units.

12. An access floor structure as defined in claim 8, wherein:

said second cover has a plurality of protrusions positioned adjacent to said raised floor member.

* * * * *